US006122476A

United States Patent [19]

Bowler, Jr.

[11] Patent Number: 6,122,476

[45] Date of Patent: Sep. 19, 2000

[54] "GREEN" RAPID RECOVERY FUSING APPARATUS

[75] Inventor: Edward F. Bowler, Jr., Fairport, N.Y.

[73] Assignee: Xerox Corporation, Stamford, Conn.

[21] Appl. No.: 09/409,892

[22] Filed: Oct. 1, 1999

[51] Int. Cl.[7] ..... G03G 15/20

[52] U.S. Cl. ..... 399/328; 219/216; 399/122

[58] Field of Search ..... 399/67, 69, 107, 399/122, 307, 320, 328; 219/216, 258, 385

[56] References Cited

U.S. PATENT DOCUMENTS

| | | | |
|---|---|---|---|
| 4,497,570 | 2/1985 | Bolte et al. | 399/307 X |
| 4,920,250 | 4/1990 | Urban | 219/216 |
| 5,724,638 | 3/1998 | Isogai et al. | 399/69 X |
| 5,729,798 | 3/1998 | Yasui et al. | 399/122 |
| 5,842,085 | 11/1998 | Mitsuya | 399/122 |
| 5,904,871 | 5/1999 | Sakai et al. | 219/216 |

FOREIGN PATENT DOCUMENTS

| | | |
|---|---|---|
| 58-203469 | 11/1983 | Japan . |
| 3-197974 | 8/1991 | Japan . |
| 3-249681 | 11/1991 | Japan . |

*Primary Examiner*—Sophia S. Chen
*Attorney, Agent, or Firm*—Tallam I. Nguti

[57] ABSTRACT

A "green" rapid recovery fusing apparatus is provided and a frame; a moveable heated fusing member, such as a rotatable heated fuser roller, mounted to the frame; a moveable pressure member, such as a rotatable pressure roller, mounted to the frame and forming a pressure fusing nip against the moveable heated fusing member; and a thermal loss preventing enclosure surrounding the heated fusing member and having low thermal conductivity walls including thermal insulating matter therein for reducing thermal loss from the heated fusing member, and for enabling rapid recovery of the heated fusing member from a standby energy saving temperature to a higher fusing temperature.

7 Claims, 3 Drawing Sheets

"GREEN" RAPID RECOVERY FUSING APPARATUS

BACKGROUND OF THE INVENTION

This invention relates generally to electrostatographic reproduction machines, and more particularly to an environmentally friendly "green" rapid recovery fusing apparatus in such a machine.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith.

Generally, the developer material comprises toner particles adhering triboelectrically to carrier granules. The toner particles are attracted from the carrier granules either to a donor roller or to a latent image on the photoconductive member. The toner attracted to a donor roller is then deposited on a latent electrostatic images on a charge retentive surface which is usually a photoreceptor. The toner powder image is then transferred from the photoconductive member to a copy substrate or sheet. The copy substrate or sheet carrying the powder image is then moved to a heat and pressure fusing apparatus, for example, where the toner powder particles are heated in order to fuse and permanently affix them to the copy substrate or sheet.

As is well known, when started up, each reproduction machine typically goes through a warm up phase during which the heated member of the fusing apparatus gradually warms up to where the fusing channel or fusing nip reaches and can be maintained at the high fusing temperature. After that, the machine can be activated to run a job reproducing images through a run or operating cycle. After one of such jobs, the machine may be idle (or even go into an idle or a "standby" mode), while waiting for the next reproduction job. Conventionally, an efficiency practice as disclosed for example in U.S. Pat. No. 4,920,250 has been to turn off the power supply upon entering a idle or standby mode, and to allow the temperature of the fusing nip or channel to drop to, and to then be controlled by restarting and shutting off the power supply, at a lower temperature level.

Consistent with such a conventional practice, environmentally sensitive and market place regulations, now call for office equipment, particularly electrostatographic reproduction machines, to be more energy efficient. Such environmental regulations or requirements for office products are covered in the US under what is currently called the "Energy Star Program", and under various other similar programs in Europe and elsewhere. Such similar programs include "New Blue Angel" (Germany), "Energy Conservation Law" (Japan), "Nordic Swan" (North Europe), and "Swiss Energy Efficiency Label" (Switzerland).

Under the "Energy or Power Star Program" in the United States, several modes are defined for copiers or electrostatographic reproduction machines. These modes for example include the operating or copying mode, the standby mode, and the low-power or energy-saver mode. The low-power or energy-saver mode is the lowest power state a copier can automatically enter within some period of copier inactivity, without actually turning off. The copier enters this mode within a specified period of time after the last copy was made. When the copier is in this mode, there may be some delay before the copier will be capable of making the next copy. For purposes of determining the power consumption in this low-power mode, a company may choose to measure the lowest of either the energy-saver mode or the standby mode.

Responsible Corporations have committed to implementing "Green" concepts in their products, and are planning to have as many products as possible receive an "Energy Star" award/classification. As part of this, guidelines for their products include provisions for an energy saver mode, in which power consumption is allocated and limited. For example, in mid volume toner reproduction machines, the power allocated is limited 150–200 watts.

The copier or machine enters the standby mode when it is not in the operating or copying mode making copies, but had just previously been in the operating mode. In the standby mode, the copier or machine is consuming less power than when the machine is in the operating mode but is ready to make a copy, and has not yet entered into the energy-saver mode. When the copier is in the standby mode, there will be virtually no delay before the copier is back in the operating mode and capable of making the next copy.

When the machine is in the low-power or energy-saver mode, these regulations call for the total power being consumed by the machine to be limited to no more than 125 watts, of which no more than 50 watts can be to the fusing apparatus. When the copier or machine experiences prolonged low-power or energy-saver mode periods, this level of limited power (50 watts) to the fusing apparatus usually is only sufficient to maintain the temperature of the fusing apparatus at a temperature that is significantly below the desired high and ready-to-run fusing temperature of about 350 degrees Fahrenheit.

Timely and satisfactory recovery from such a significantly low low-power or energy-saver mode temperature back to the desired high fusing temperature is ordinarily difficult. This is because once the temperature of a fusing apparatus starts to drop or fall, it acquires a thermal inertia which then makes reversal or recovery difficult. Unfortunately, the "power or energy star" regulations, have made such a concern a problem for conventionally designed and controlled fusing apparatus, by calling for the reproduction machine to fully recover from such a low-power or energy-saver mode temperature back up to the desired, high fusing temperature in 30 seconds or less. Under conventional practice, recovery times have been found to be unacceptably long and beyond the 30 seconds called for by the regulations.

SUMMARY OF THE INVENTION

According to the present invention, there is provided a "green" rapid recovery fusing apparatus is provided and a frame; a moveable heated fusing member, such as a rotatable heated fuser roller, mounted to the frame; a moveable pressure member, such as a rotatable pressure roller, mounted to the frame and forming a pressure fusing nip against the moveable heated fusing member; and a thermal loss preventing enclosure surrounding the heated fusing member and having low thermal conductivity walls including thermal insulating matter therein for reducing thermal loss from the heated fusing member, and for enabling rapid recovery of the fusing member from a standby energy saving temperature to a higher fusing temperature.

DESCRIPTION OF THE DRAWINGS

In the detailed description of the invention presented below, reference is made to the drawings, in which.

DETAILED DESCRIPTION OF THE INVENTION

Figure 1:
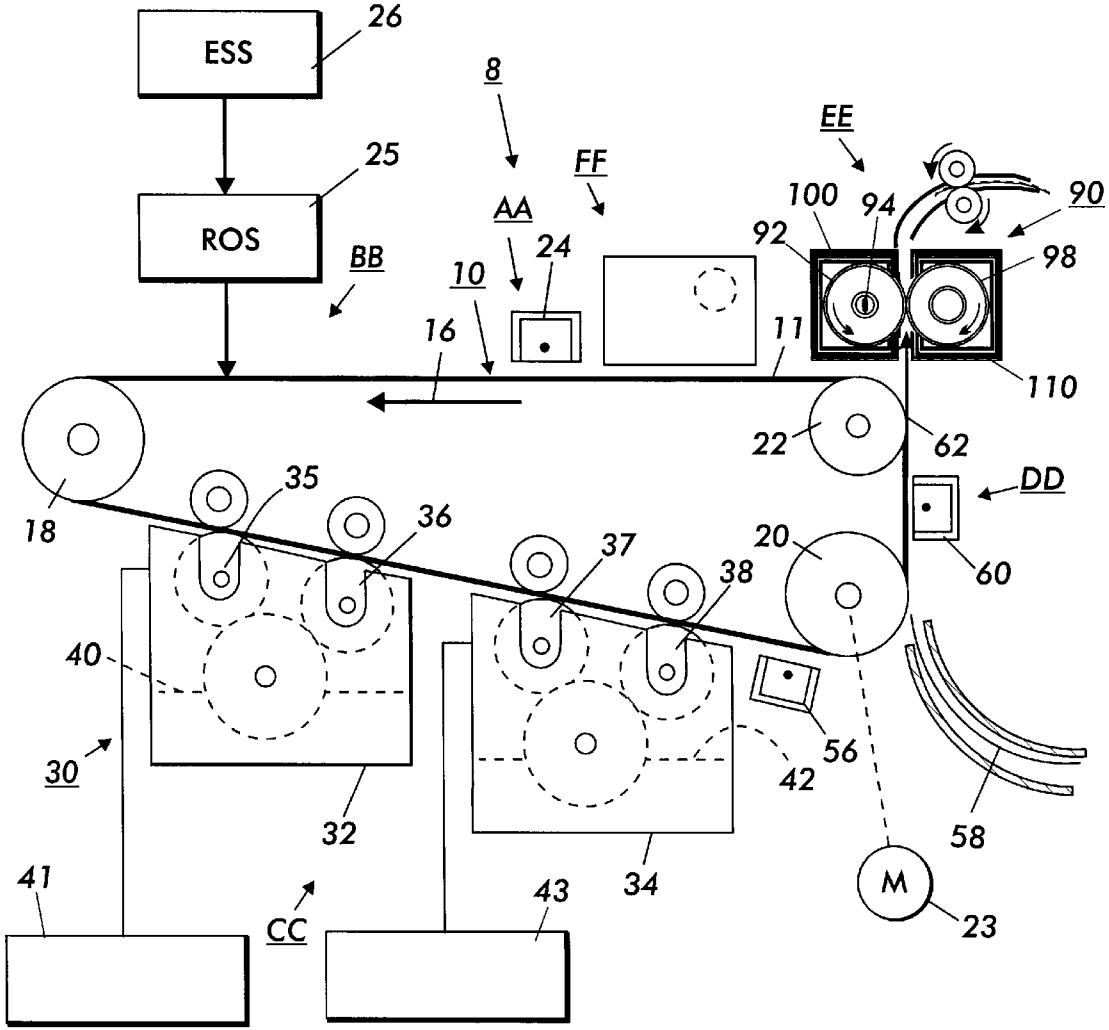
FIG. 1 is a schematic illustration of an electrostatographic reproduction machine incorporating the "green" rapid recovery fusing apparatus of the present invention.

While the present invention will be described in connection with a preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements. Referring now to the drawing (FIG. 1), where the showings are for the purpose of describing a preferred embodiment of the invention and not for limiting same, and where the various processing stations employed in an electrostatographic reproduction machine as illustrated in FIG. 1, will be described only briefly.

As illustrated, an electrostatographic reproduction machine 8, in which the present invention finds advantageous use, utilizes a charge retentive image bearing member in the form of a photoconductive belt 10 consisting of a photoconductive surface 11 and an electrically conductive, light transmissive substrate. The belt 10 is mounted for movement past a series of electrostatographic process stations including a charging station AA, an exposure station BB, developer stations CC, transfer station DD, fusing station EE and cleaning station FF. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Roller 20 is coupled to motor 23 by suitable means such as a belt drive. Motor 23 rotates roller 20 to advance belt in the direction of arrow 16.

As can be seen by further reference to FIG. 1, initially successive portions of belt 10 pass through charging station AA. At charging station AA, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station BB. At exposure station BB, the uniformly charged photoreceptor or charge retentive surface 10 is exposed to a laser based input and/or output scanning device 25 which, as controlled by controller or ESS 26, causes the charge retentive surface to be discharged in accordance with the output from the scanning device. The ESS 26, for example, is the main multitasking processor for operating and controlling all of the other machine subsystems and printing operations, including aspects of the present invention. The scanning device is a three level laser Raster Output Scanner (ROS). The resulting photoreceptor contains both charged-area images and discharged-area images.

At development station CC, a development system, indicated generally by the reference numeral 30 advances developer materials into contact with the electrostatic latent images, and develops the image. The development system 30, as shown, comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40, by way of example, contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pretransfer corona discharge member 56 is provided to condition the toner for effective transfer to a substrate using corona discharge of a desired polarity, either negative or positive.

Sheets of substrate or support material 58 are advanced to transfer station DD from a supply tray, not shown. Sheets are fed from the tray by a sheet feeder, also not shown, and advanced to transfer station DD through a corona charging device 60. After transfer, the sheet continues to move in the direction of arrow 62 towards fusing station EE.

Figure 2:
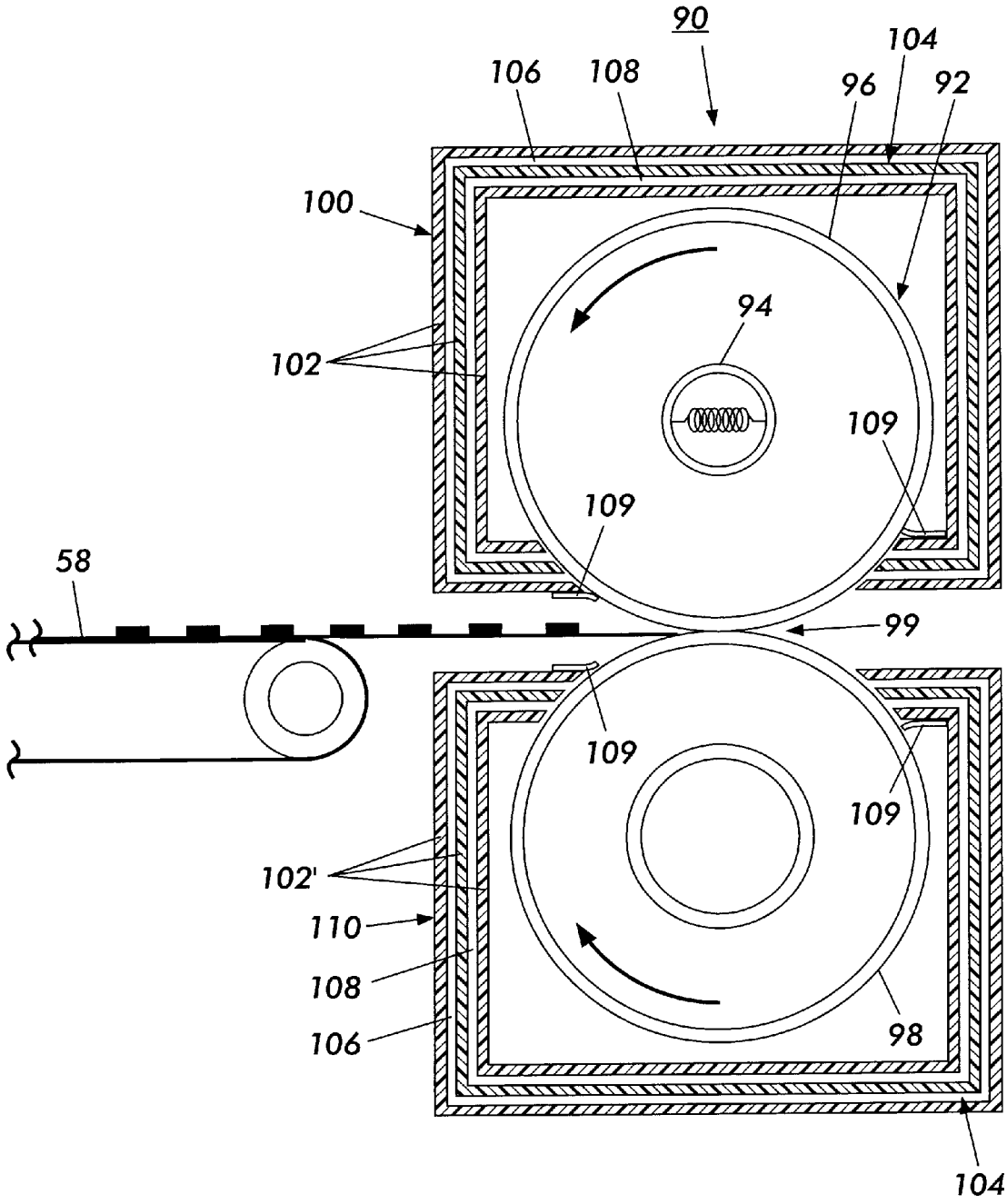
FIG. 2 is an enlarged detailed representation of the "green" rapid recovery fusing apparatus of the machine of FIG. 1 including a first insulating technique in accordance with the present invention.
Figure 3:
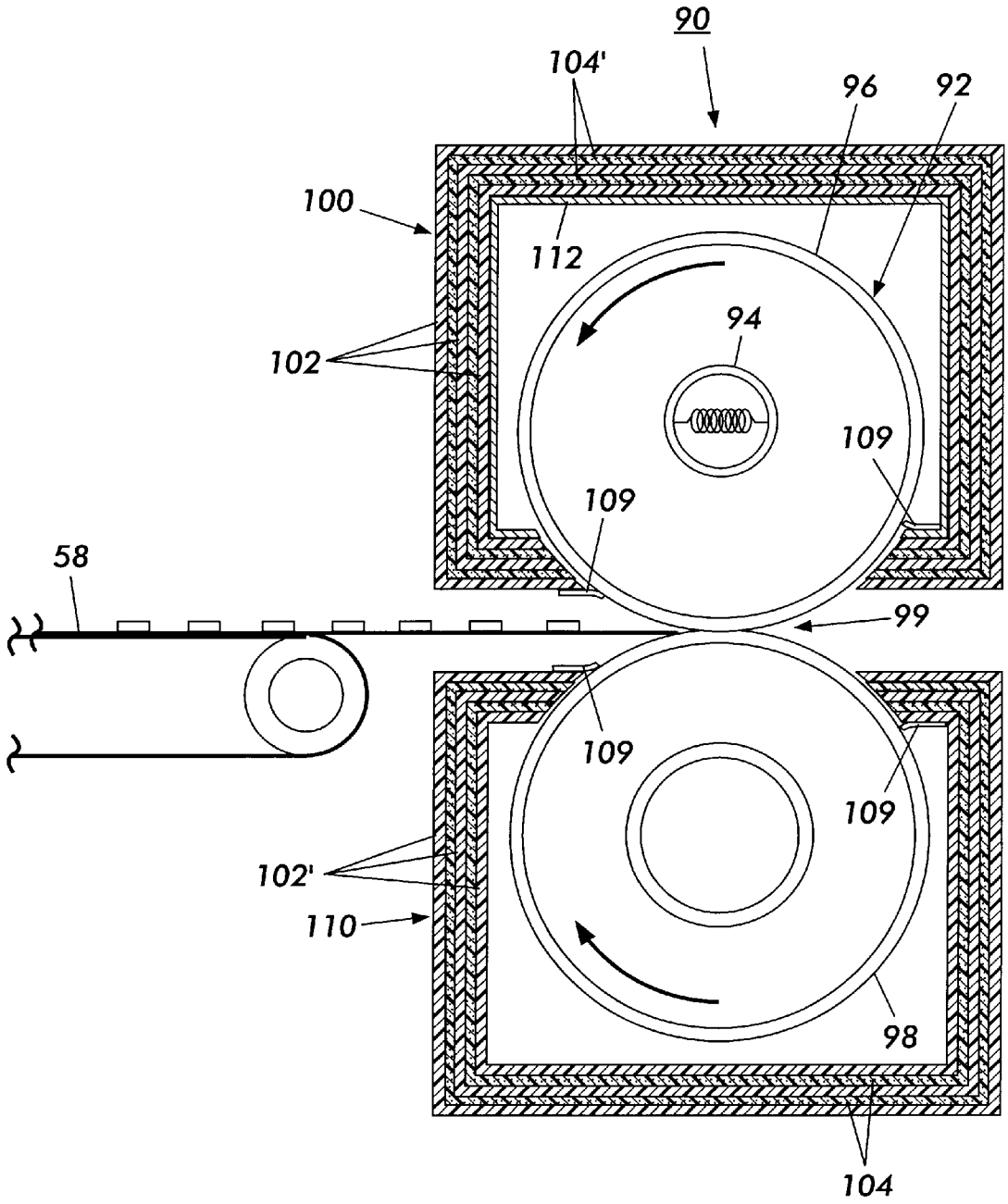
FIG. 3 is an enlarged detailed representation of the "green" rapid recovery fusing apparatus of the machine of FIG. 1 including a second insulating technique in accordance with the present invention.

Referring now to FIGS. 1–3, fusing station EE includes a "green" rapid recovery fusing apparatus 90 in accordance with the present invention. As illustrated, the "green" rapid recovery fusing apparatus 90 includes a frame (not labeled) and a moveable heated fusing member such as a rotatable fuser roller 92. Although a heated fusing member is shown as a roller 92, it is understood that it equally can be a belt. Fusing member or fuser roller 92 is heated for example by a heating device 94 (shown as an internal lamp but as well could be an external heater) for elevating temperatures of the surface 96 of the fuser roller to a suitable toner fusing temperature. The "green" rapid recovery fusing apparatus 90 also includes a moveable pressure member, such as a rotatable pressure roller 98, that forms a fusing nip 99 against the moveable fusing member or rotatable fuser roller 92.

Importantly, the "green" rapid recovery fusing apparatus 90 includes a thermal loss preventing enclosure 100 surrounding at least the heated fuser roller 92. The thermal loss preventing enclosure 100 has low thermal conductivity walls 102 made for example of high temperature plastic material, and including thermal insulating matter 104, 104' therein for reducing thermal loss from the heated fuser roller 92, and for enabling rapid recovery of the fuser roller 92 from a standby energy saving temperature to a higher fusing temperature. In one embodiment as shown in FIG. 2, the thermal insulating matter 104 preferably is comprised of a number of air pockets, for example, a pair of, or two such air pockets 106, 108. The thermal loss preventing enclosure 100 may also include seal members 109 which seal against the rotating fuser roller 92 in order to further trap and retain as much heat as possible within the enclosure 100. In a second embodiment as shown in FIG. 3, the thermal insulating matter therein is comprised of a closed cell insulating foam 104' that is sprayed into cavities within the low thermal conductivity walls 102.

As further shown in FIG. 3, thermal loss preventing enclosure 100 may include an energy reflective shield 112 that is mounted on an inside surface of the walls 102, and such that it faces the heated fuser roller 92 for reflecting infrared energy, for example, from the heated fuser roller, back onto the heated fuser. As also illustrated in FIGS. 1–3, the "green" rapid recovery fusing apparatus 90 may also include a thermal loss preventing enclosure 110 that surrounds the pressure roller 98. The thermal loss preventing enclosure 110 also has low thermal conductivity walls 102' that are made of high temperature plastic material, and may also include thermal insulating matter therein for reducing thermal loss from the pressure roller 98 and from the heated fuser roller 92 which is in a heat-exchange nip contact with the pressure roller 98. To further conserve heat, the spacing around the nip area between the enclosure 110 and the enclosure 100 is preferably kept to a minimum, at least wide enough not to disturb unfused toner images on incoming sheets. The thermal loss preventing enclosure 110 thereby further enables rapid recovery of the fuser roller 92 from a standby energy saving temperature to a higher fusing temperature.

Additionally, fuser and pressure roll shafts preferably each have as minimum a cross-section as possible. The fuser cover or enclosure 100 should be as air tight as possible particularly around the fuser and pressure rolls 92, 98 in order to reduce convection and radiation losses, and the walls of the rollers 92, 98 should be as thin as possible. The fuser cover or enclosure materials, such as the preferred high temperature plastic material, preferably should exhibit low emissivity or should have coatings so as to reduce radiation losses. The power available to the "green" rapid recovery fusing apparatus 90 as a whole should be about 80–120 watts, and this should be sufficient to maintain the fuser roll temperature near and just below the ready temperature.

Advantageously, the thermal loss preventing enclosures 100, 110 operate to reduce thermal losses and to shorten the recovery time from the energy saving mode of the fusing apparatus 90. The enclosures 100, 110 are such that heat losses due convection, radiation and conduction are minimized during fusing and idle periods of the apparatus 90. Additionally, they enable the fusing apparatus 90 to use what power (typically 50–100 watts), that is available in the energy saver mode, to maintain the temperature of the fuser roller 92 significantly above ambient, or the temperature outside the enclosures 100, 110. Consequently, the recovery time from a saver mode temperature to a "ready" temperature will likely and easily meet the "Energy Star" guideline.

As can be seen, there has been provided a "green" rapid recovery fusing apparatus is provided and a frame; a moveable heated fusing member, such as a rotatable heated fuser roller, mounted to the frame; a moveable pressure member, such as a rotatable pressure roller, mounted to the frame and forming a pressure fusing nip against the moveable heated fusing member; and a thermal loss preventing enclosure surrounding the fuser roller and having low thermal conductivity walls including thermal insulating matter therein for reducing thermal loss from the heated fuser roller, and for enabling rapid recovery of the fuser roller from a standby energy saving temperature to a higher fusing temperature.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A "green" rapid recovery fusing apparatus comprising:

(a) a frame;

(b) a moveable heated fusing member mounted to said frame;

(c) a moveable pressure member mounted to said frame and forming a pressure fusing nip against said moveable heated fusing member; and (d) a thermal loss preventing enclosure surrounding said heated fusing member and having low thermal conductivity walls including thermal insulating matter therein for reducing thermal loss from said heated fusing member and enabling rapid recovery of said heated fusing member from a standby energy saving temperature to a fusing temperature higher than the standby energy saving temperature, said thermal loss preventing enclosure including an energy reflective shield mounted on an inside surface of said walls facing said heated fusing member for reflecting infrared energy from said heated fusing member back onto said heated fusing member, and seal members mounted to said low thermal conductivity walls for contacting and sealing against said moveable fusing member to trap and retain heat within said thermal loss preventing enclosure.

2. The "green" rapid recovery fusing apparatus of claim 1, wherein said thermal insulating matter within said walls includes a plurality of air gaps.

3. The "green" rapid recovery fusing apparatus of claim 1, wherein said thermal insulating matter therein is comprised of a closed cell insulating foam.

4. The "green" rapid recovery fusing apparatus of claim 1, including a thermal loss preventing enclosure surrounding said moveable pressure member and having low thermal conductivity walls including thermal insulating matter therein for reducing thermal loss from said moveable pressure member and from said heated fusing member in nip contact with said moveable pressure member, thereby further enabling rapid recovery of said heated fusing member from the standby energy saving temperature to the fusing temperature.

5. An electrostatographic reproduction machine comprising:

(a) a movable image bearing member having a toner image carrying surface defining a path of movement therefor;

(b) electrostatographic devices mounted along said path of movement for forming a toner image on said toner image carrying surface;

(c) means for transferring said toner image from said toner image carrying surface onto a substrate; and (d) a "green" rapid recovery fusing apparatus for heating and fusing said toner image onto said substrate, said "green" rapid recovery fusing apparatus including:

(i) a frame;

(ii) a moveable heated fusing member mounted to said frame;

(iii) a moveable pressure member mounted to said frame and forming a pressure fusing nip against said moveable heated fusing member such as a rotatable heated fuser roller; and (iv) a thermal loss preventing enclosure surrounding said heated fusing member and having low thermal conductivity walls including thermal insulating matter therein for reducing thermal loss from said heated fusing member, and enabling rapid recovery of said heated fusing member from a standby energy saving temperature to a fusing temperature higher than the standby energy saving temperature, said thermal loss preventing enclosure including an energy reflective shield mounted on an inside surface of said walls facing said heated fusing member for reflecting infrared energy from said heated fusing member back onto said heated fusing member, and seal members mounted to said low thermal conductivity walls for contacting and sealing against said moveable fusing member to trap and retain heat within said thermal loss preventing enclosure.

6. The electrostatographic reproduction machine of claim 5, wherein said thermal insulating matter within said low conductivity walls is comprised of a closed cell insulating foam.

7. The electrostatographic reproduction machine claim 5, including a thermal loss preventing enclosure surrounding said pressure member and having low thermal conductivity walls including thermal insulating matter therein for reducing thermal loss from said pressure member and from said heated fuser roller in nip contact with said pressure member, thereby further enabling rapid recovery of said fuser roller from the standby energy saving temperature to the fusing temperature.

* * * * *